US007412204B2

(12) United States Patent
Noro et al.

(10) Patent No.: US 7,412,204 B2
(45) Date of Patent: Aug. 12, 2008

(54) DISTRIBUTOR AND BROADCAST SIGNAL RECEIVING SYSTEM USING THE SAME

(75) Inventors: Junichi Noro, Akita (JP); Takao Kato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 699 days.

(21) Appl. No.: 10/999,151

(22) Filed: Nov. 30, 2004

(65) Prior Publication Data

US 2005/0153652 A1 Jul. 14, 2005

(30) Foreign Application Priority Data

Jan. 8, 2004 (JP) ..... P. 2004-002938

(51) Int. Cl.
*H04H 20/74* (2008.01)

(52) U.S. Cl. ..... 455/3.02; 455/19; 455/12.1; 455/280; 455/290; 455/552.1; 455/556.1; 455/562.1; 455/575.7

(58) Field of Classification Search ..... 455/3.02, 455/19, 12.1, 280, 290, 552.1, 553.1, 556.1, 455/557, 562, 575.7; 343/700 R
See application file for complete search history.

(56) References Cited

U.S. PATENT DOCUMENTS 7,340,274 B2 * 3/2008 Harano ..... 455/556.1

FOREIGN PATENT DOCUMENTS

JP 2003-151377 5/2003

* cited by examiner

*Primary Examiner*—Matthew Anderson
*Assistant Examiner*—Shaima Q Aminzay
(74) *Attorney, Agent, or Firm*—Whitham Curtis Christofferson & Cook, PC

(57) ABSTRACT

A distributor arranged between a tuner module and an antenna, the tuner module including a first input portion and a second input portion for inputting a satellite broadcast signal transmitted from an artificial satellite and a ground broadcast signal transmitted from a ground base station respectively, and the antenna receiving either one of the broadcast signals. The distributor includes a first connector portion connected to the antenna; a second connector portion connected to the first input portion; a third connector portion connected to the second input portion; and a junction connecting portion distributing the signal inputted to the first connector portion to the second and the third connector portions. A drive voltage of the antenna inputted from the first input portion is outputted to the antenna. The voltage outputted to the antenna is fed back to the second input portion through the junction connecting portion and the third connector portion.

9 Claims, 2 Drawing Sheets

DISTRIBUTOR AND BROADCAST SIGNAL RECEIVING SYSTEM USING THE SAME

BACKGROUND OF THE INVENTION

The present invention relates to a distributor for distributing a signal received by an antenna to a tuner module having a plurality of input portions, further in details, relates to a distributor preferably used in a case of connecting a single antenna to a tuner module for detecting connection or the antenna by feeding back a drive voltage of the antenna inputted from one input portion to other input portion and a broadcast signal receiving system using the same.

In recent years, there is proposed a satellite radio broadcast by transmitting to broadcast a signal including vocal information from an artificial satellite orbiting an earth orbit. Currently, in the United States, there is proposed such a satellite radio broadcast by XM Satellite Radio Corporation. In the satellite radio broadcast, a signal transmitted from an artificial satellite can be received in a wide area on the earth and therefore, attention is attracted thereto since the satellite radio broadcast is preferable not only for use of receiving and herring the broadcast by installing a receiver at a fixed location of a general household or the like but also for use of receiving and herring the broadcast by mounting a receiver to a moving body (for example, a vehicle body) or, for example, an automobile or the like.

In a vehicle-mounted receiving system for receiving satellite radio broadcast, both of satellite radio broadcast and ground radio broadcast which has conventionally been used widely are received by a single tuner module for the purpose of reducing a number of parts to achieve low cost.

According to such a vehicle-mounted receiving system, as shown in FIG. 5, a tuner module 101 having a first input portion 110 connected to a satellite wave antenna for receiving satellite radio broadcast, a second input portion 111 connected to a ground wave antenna for receiving ground radio broadcast and input/output terminals 112 connected to respective portions on a side of the receiver 100 are provided in a receiver 100 which is mounted to a vehicle. Further, the tuner module 101 includes an antenna detecting circuit 113 for detecting that the respective antennas are connected by inputting a drive voltage of an antenna 120 inputted from the first input portion 110 is fed back through the antenna to input from the second input portion 111.

According to the related tuner module 101, in a state that a satellite wave antenna and a ground wave antenna are respectively connected to the first input portion 110 and the second input portion 111, a drive voltage (drive power) inputted from the input/output terminals 112 is outputted to the respective antennas Via the first input portion 110 to be fed back from the respective antennas to the second input portion 111. Further, the antenna detecting circuit 113 detects that the respective antennas are normally connected, thereby the tuner module 101 is normally operated under the state (for example, see JP-A-2003-151377).

The related tuner module 101 is normally operated as described above when the satellite wave antenna and the ground wave antenna are respectively connected to the tuner module 101 in a state that the antenna module having both of the satellite wave antenna and the ground wave antenna is connected to the tuner module 101, for example, as shown in FIG. 5. However, when a single antenna for receiving only either one of a satellite wave or a ground wave is connected to the tuner module 101, a voltage is not applied to a side of the antenna detecting circuit 113 and therefore, connection of the antenna is not detected and the tuner module 101 cannot be operated normally. When a single antenna is used, there is a case in which a tuner module in correspondence with the single antenna needs to use to bring about an increase in fabrication cost.

SUMMARY OF THE INVENTION

Hence, the invention has been carried out in view of the above-described actual situation and it is an object thereof to provide a distributor capable of normally operating a tuner module even when a single antenna is connected to the tuner module including two routes of input portions and constituted by a structure of detecting connection of the antenna by feeding back a drive voltage at the respective input portions and a broadcast signal receiving system using the same.

In order to achieve the above object, according to the present invention, there is provided a distributor arranged between a tuner module and an antenna, the tuner module including a first input portion for inputting one of a satellite broadcast signal transmitted from an artificial satellite and a ground broadcast signal transmitted from a ground base station and a second input portion for inputting other of the satellite broadcast signal and the ground broadcast signal, and the antenna receiving either one of the satellite broadcast signal and the ground broadcast signal, the distributor, comprising:

a first connector portion, connected to the antenna;

a second connector portion, connected to the first input portion;

a third connector portion, connected to the second input portion; and a junction connecting portion, distributing the signal inputted to the first connector portion to the second and the third connector portions, wherein a drive voltage of the antenna inputted from the first input portion through the second connector portion is supplied to the antenna through the first connector portion; and wherein the voltage outputted to the antenna is fed back to the second input portion through the junction connecting portion and the third connector portion.

According to the present invention, there is also provided a distributor arranged between a tuner module and an antenna, the tuner module including a first input portion for inputting one of a satellite broadcast signal transmitted from an artificial satellite and a ground broadcast signal transmitted from a ground base station and a second input portion for inputting other of the satellite broadcast signal and the ground broadcast signal, and the antenna receiving either one of the satellite broadcast signal and the ground broadcast signal, the distributor, comprising:

a first connector portion, connected to the antenna;

a second connector portion, connected to the first input portion;

a third connector portion, connected to the second input portion;

a junction connecting portion, distributing the signal inputted to the first connector portion to the second and the third connector portions; and a signal level compensating portion, compensating a signal loss at the junction connecting portion, and provided between the first connector portion and the junction connecting portion.

According to the present invention, there is also provided a broadcast signal receiving system, comprising;

a tuner module, including:

a first input portion, inputting one of a satellite broadcast signal transmitted from an artificial satellite and a ground broadcast signal transmitted from a ground base station; and a second input portion, inputting other of the satellite broadcast signal and the ground broadcast signal;

an antenna, receiving either one of the satellite broadcast signal and the ground broadcast signal;

a distributor, arranged between the tuner module and the antenna, and including:

a first connector portion, connected to the antenna;

a second connector portion, connected to the first input portion;

a third connector portion, connected to the second input portion;

a junction connecting portion, distributing the signal inputted to the first connector portion to the second and the third connector portions; and a signal level compensating portion, compensating a signal loss at the junction connecting portion, the signal level compensating portion being provided between the first connector portion and the junction connecting portion, wherein the tuner module includes an antenna connection detector which detects whether the antenna is connected to the tuner module through the divider;

wherein a drive voltage of the antenna inputted from the second connector portion is supplied to the antenna; and wherein the drive voltage supplied to the antenna is fed back to the second input portion through the junction connecting portion and the third connector portion so that the voltage is supplied to the antenna connection detector in the tuner module.

According to the distributor and the broadcast signal receiving system of the invention, the tuner module can normally be operated even when a single antenna is connected to the tuner module which needs two inputs. Thereby, the tuner module including two routes of the input portions can commonly be used for a case of connecting two antennas and a case of connecting a single antenna to be able to contribute to a reduction in a product cost.

Further, by providing the low noise amplifier before distributing the signal, the amplifier which has been needed to the two routes after distribution in the background art may be provided only to one route to be able to reduce cost.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A detailed explanation will be given of an embodiment of the invention in reference to the drawings as follows. In the following, an explanation will be given by exemplifying a receiving system 10 shown in FIG. 1 as a receiving system having a distributor according to the invention. Further, although the receiving system 10 is used for a so-to-speak vehicle-mounted radio broadcast receiving system which is mounted on a vehicle of an automobile or the like, the invention is not limited to the vehicle-mounted radio broadcast receiving system. For example, this invention is applied to a mobile radio broadcast receiving apparatus.

Figure 1:
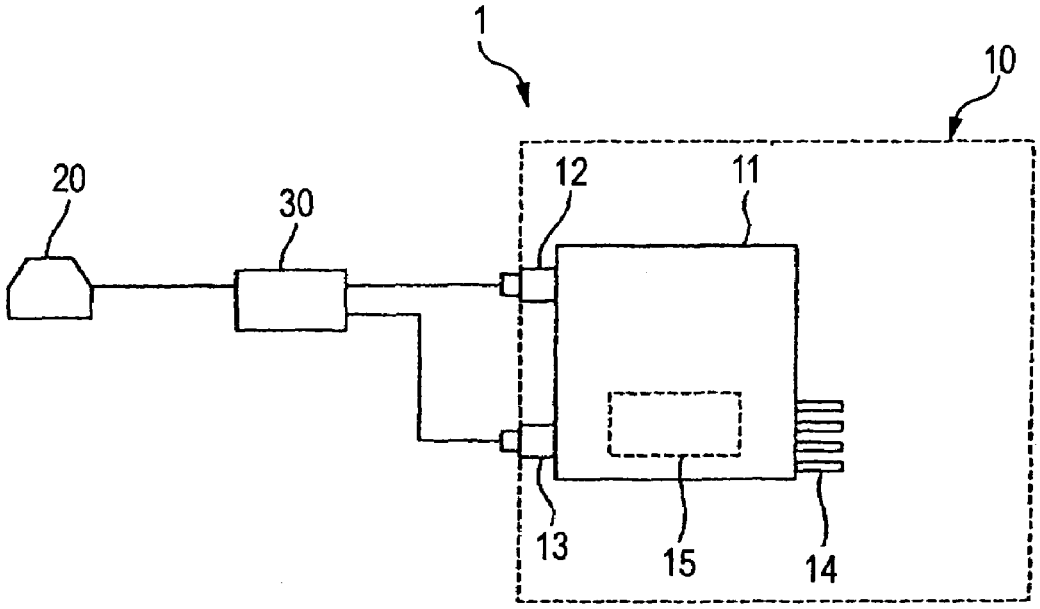
FIG. 1 is an outline constitution view showing a receiving system using a distributor according to an embodiment of the invention.

As shown in FIG. 1, a receiving system 1 is arranged with a tuner module 11 having a first input portion 12 connected to a satellite wave antenna for receiving satellite radio broadcast, a second input portion 13 connected to a ground wave antenna for receiving ground radio broadcast, and a tuner module 11 having input/output terminals 14 connected to respective portions on a side of the receiver 10 mounted to a vehicle. Further, the tuner module 11 includes an antenna detecting circuit is for detecting that the respective antennas are connected by feeding back a drive voltage of the antenna inputted from the first input portion 12 via the second input portion 13.

According to the tuner module 11, in a state that the satellite wave antenna and the ground wave antenna are respectively connected to the first input portion 12 and the second input portion 13, a drive voltage (drive power) inputted from the input/output terminals 14 is outputted to the respective antennas via the first input portion 12 and is fed back from the respective antennas via the second input portion 13. Further, under the state, the antenna detecting circuit 15 detects that the respective antennas are normally connected and the tuner module 15 is normally operated by the drive voltage inputted from the second input portion 13.

As shown in FIG. 1, when, for example, an antenna module 20 having only the satellite wave antenna is connected to the tuner module 11, a signal distributor 30 according to the invention is arranged between the tuner module 11 and the antenna module 20.

Further, although according to the embodiment, an explanation will be given by assuming a case in which the antenna module 20 is provided only with the satellite wave antenna, operation and effect similar to those in the following explanation are naturally achieved even in a case in which the antenna module 20 is provided only with the ground wave antenna.

Figure 2:
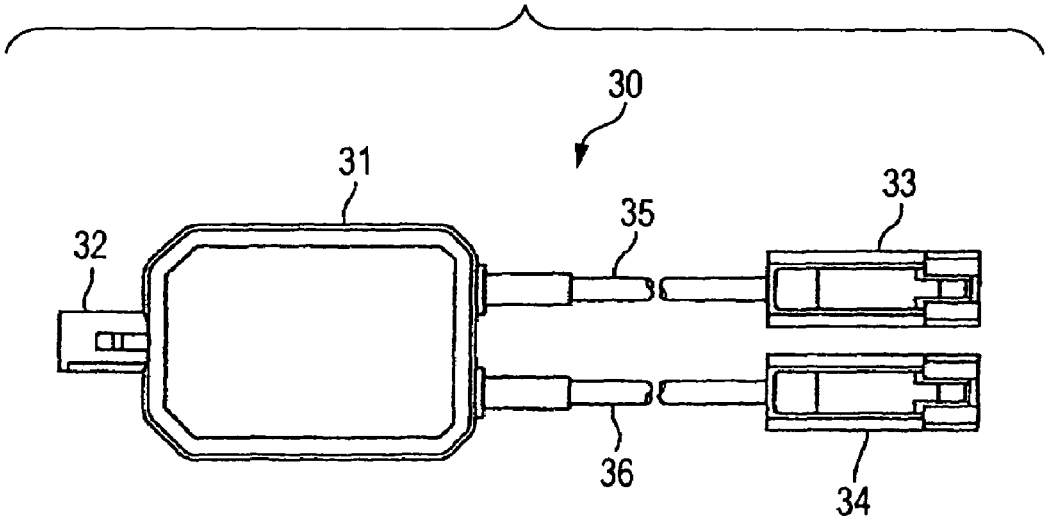
FIG. 2 is a plane view showing the distributor.

As shown in FIG. 2, the distributor 30 includes a main body case 31 containing a voltage feedback circuit and a signal level compensating circuit, a first connector portion 32 connected to the antenna module 20, a second connector portion 33 connected to the first input portion 12 of the tuner module 11, and a third connector portion 34 connected to the second input portion 13 of the tuner module 11. Further, a first signal cable 35 and a second signal cable 36 respectively connect intervals between the main body case 31 and the second connector portion 33 as well as the third connector portion 34.

Next, an example of circuit configurations of the voltage feedback circuit and the signal level compensating circuit contained in the main body case 31 will be explained in reference to FIG. 3.

Figure 3:
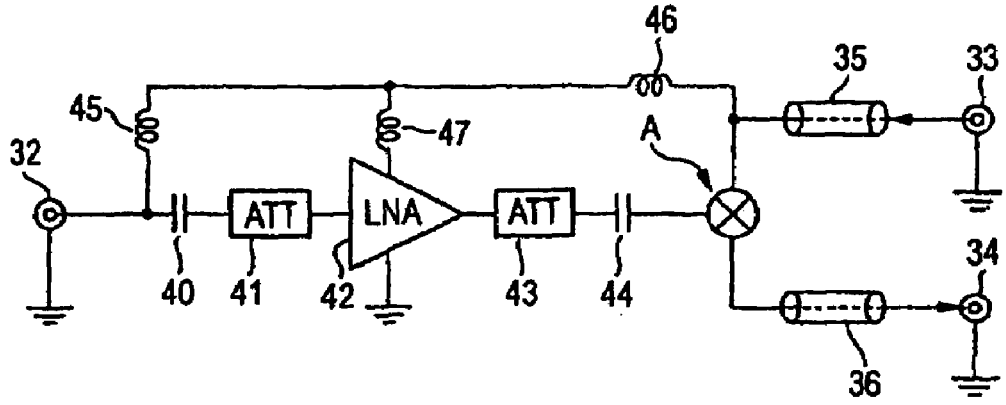
FIG. 3 is a circuit diagram showing a constitution of a circuit of the distributor.

The distributor 30 includes a circuit in which the first to third connectors 32, 33, 34 are electrically connected by a junction connecting portion A as shown in, for example, FIG. 3. Further, a first capacitor 40, a first attenuator 41, a low noise amplifier (LNA) 42, a second attenuator 43, and a second capacitor 44 are arranged between the first connector 32 and the junction connecting portion A, in the order from a side of the first connector 32. A terminal or the first capacitor 40 on a side of the first connector 32 is connected also to the junction connecting portion A via a first coil 45 and a second coil 46. Further, LNA 42 is connected also to the junction connecting portion A via a third coil 47 and the second coil 46.

According to the distributor 30 having the above-described circuit constitution, a signal outputted from the antenna module 20 is inputted to the first connector portion 32. The inputted signal is outputted to the second connector portion 33. Further, a signal level of a signal distributed at the junction connecting portion A is amplified so as to compensate about 3 dB (about ½ of input signal level) of an amount of a signal level loss in distributing the signal as well as a contact loss (in correspondence with about 1 dB) at the first to the third connector portions 32, 33, 34 by LNA 42 provided at a prestage of the junction connecting point A.

Further, the signal level may be amplified by compensating for cable loss by, for example, the cable connecting the interval between the main body case 31 and the antenna module 20 or the tuner module 11 in addition to the loss by shunting and distributing the signal. Further, when a sufficient amplifying characteristic can be ensured, other various amplifiers may be used instead of LNA 42.

The LNA 42 is provided at the prestage of the junction connecting portion A and amplifies the signal before distributing the signal. Thereby, although amplifiers need to provide normally for respective two routes after distribution, LNA 42 may be provided only to one route and the cost can be reduced.

Further, a drive voltage inputted from the second connector portion 33 is distributed at the junction connecting portion A and is outputted to the antenna module 20 from the first connector portion 32 via the second coil 46 end the first coil 45. Further, the drive voltage distributed by the junction connecting portion A is outputted to the third connector portion 34. Further, a portion of the drive voltage distributed by the junction connecting portion A and outputted to the antenna module 20 is inputted to LNA 42 via the third coil 47.

Since the distributor 30 has the circuit having the constitution shown in FIG. 3, the circuit serves as the distributing circuit electrically connected to the first connector portion 32, the second connector portion 33, and the third connector portion 34 as a whole, further, the distributor 30 serves also as a voltage return circuit for outputting the drive voltage inputted from the first input portion 12 via the second connector portion 33 and outputting the drive voltage to the second input portion 13 via the third connector portion 34.

Therefore, even when a single antenna (antenna module 20) is connected to a tuner module (tuner module 11) which includes two routes of input portions and the detecting circuit for detecting connection of an antenna by feeding back a drive voltage at the respective input portions, the tuner module can normally be operated. Thereby, the tuner module having two routes of the input portions can commonly be used for a case of connecting two antennas and a case of connecting a single antenna to be able to contribute to a reduction in product cost.

Next, a second embodiment of a divider according to the invention will be explained below in reference to FIG. 4. Further, a circuit of the divider shown in FIG. 4 is substantially similar to the circuit constitution shown in FIG. 3, also operation and effect achieved by the constitution are similar to those of the constitution shown in FIG. 3 and therefore, in the following, only a point of difference from the circuit constitution shown in FIG. 3 will be explained.

Figure 4:
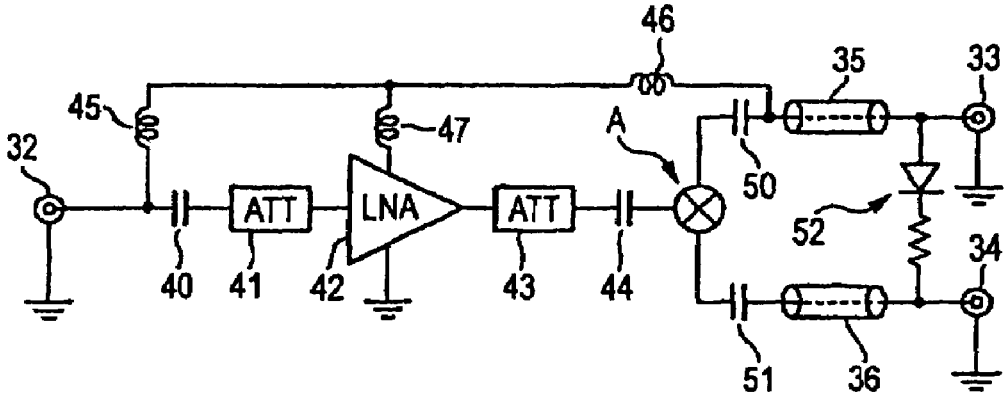
FIG. 4 is a circuit diagram showing another constitution of a circuit of the distributor.
Figure 5:
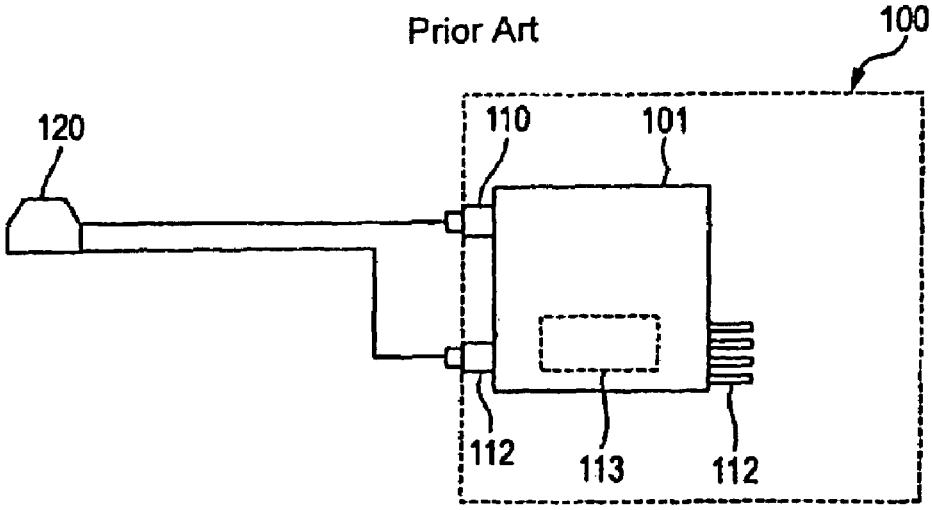
FIG. 5 Prior Art
FIG. 5 is an outline constitution view showing a receiving system using the related distributor.

According to the second embodiment shown in FIG. 4, a third and a fourth capacitor 50, 51 are arranged respectively between the second coil 46 and the junction connecting portion A as well as between the junction connecting portion A and the third connector portion 34. Further, the second connector portion 33 and the third connector portion 34 are short-circuited via a switching diode 52.

According to the distributor 30 of the second embodiment, the switching diode 52 serves as a so-to-speakbypass circuit, and when the drive voltage inputted from the first connector portion 33 is fed-back to the second connector portion 34, a level of the voltage to be fed back can be variably changed.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-002938 filed on Jan. 8, 2004, the contents of which are incorporated herein for reference.

What is claimed is:

1. A distributor arranged between a tuner module and an antenna, the tuner module including a first input portion for inputting one of a satellite broadcast signal transmitted from an artificial satellite and a ground broadcast signal transmitted from a ground base station and a second input portion for inputting other of the satellite broadcast signal and the ground broadcast signal, and the antenna receiving either one of the satellite broadcast signal and the ground broadcast signal, the distributor, comprising:

a first connector portion, connected to the antenna;

a second connector portion, connected to the first input portion;

a third connector portion, connected to the second input portion; and a junction connecting portion, distributing the signal inputted to the first connector portion to the second and the third connector portions, wherein a drive voltage of the antenna inputted from the first input portion through the second connector portion is supplied to the antenna through the first connector portion; and wherein the voltage outputted to the antenna is fed back to the second input portion through the junction connecting portion and the third connector portion.

2. The distributor as set forth in claim 1, wherein the second connector portion and the third connector portion are short-circuited through a switching diode which variably changes a level of the voltage for feeding back the drive voltage inputted from the first connector portion to the second connector portion.

3. A distributor arranged between a tuner module and an antenna, the tuner module including a first input portion for inputting one of a satellite broadcast signal transmitted from an artificial satellite and a ground broadcast signal transmitted from a ground base station and a second input portion for inputting other of the satellite broadcast signal and the ground broadcast signal, and the antenna receiving either one of the satellite broadcast signal and the ground broadcast signal, the distributor, comprising:

a first connector portion, connected to the antenna;

a second connector portion, connected to the first input portion;

a third connector portion, connected to the second input portion;

a junction connecting portion, distributing the signal inputted to the first connector portion to the second and the third connector portions; and a signal level compensating portion, compensating a signal loss at the junction connecting portion, and provided between the first connector portion and the junction connecting portion.

4. The distributor as set forth in claim 3, wherein the signal level compensating portion is configured by a first capacitor, a first attenuator, a low noise amplifier, a second attenuator and a second capacitor which are arranged in the order.

5. The distributor as set forth in claim 4, wherein a drive voltage of the antenna inputted from the second connector portion is supplied to the antenna through the first coil and the second coil, the first coil being connected between the first connector portion and the first capacitor, the second coil being connected between the first coil and the junction connecting portion; and wherein the voltage supplied to the antenna is fed back to the second input portion through the junction connecting portion and the third connector portion.

6. The distributor as set forth in claim 3, further comprising wherein the second connector portion and the third connector portion are shortcitcuited through a switching diode which variably changes a level of the voltage for feeding back the drive voltage inputted from the first connector portion to the second connector portion.

7. A broadcast signal receiving system, comprising:

a tuner module, including:

a first input portion, inputting one of a satellite broadcast signal transmitted from an artificial satellite and a ground broadcast signal transmitted from a ground base station; and a second input portion, inputting other of the satellite broadcast signal and the ground broadcast signal;

an antenna, receiving either one of the satellite broadcast signal and the ground broadcast signal;

a distributor, arranged between the tuner module and the antenna, and including:

a first connector portion, connected to the antenna;

a second connector portion, connected to the first input portion;

a third connector portion, connected to the second input portion;

a junction connecting portion, distributing the signal inputted to the first connector portion to the second and the third connector portions; and a signal level compensating portion, compensating a signal loss at the junction connecting portion, the signal level compensating portion being provided between the first connector portion and the junction connecting portion, wherein the tuner module includes an antenna connection detector which detects whether the antenna is connected to the tuner module through the divider;

wherein a drive voltage of the antenna inputted from the second connector portion is supplied to the antenna; and wherein the drive voltage supplied to the antenna is fed back to the second input portion through the junction connecting portion and the third connector portion so that the voltage is supplied to the antenna connection detector in the tuner module.

8. The distributor as set forth in claim 7, wherein the signal level compensating portion is configured by a first capacitor, a first attenuator, a low noise amplifier, a second attenuator and a second capacitor which are arranged in the order.

9. The broadcast signal receiving system as set forth in claim 7, wherein the second connector portion and the third connector portion are shortcircuited through a switching diode which variably changes a level of the voltage for feeding back the drive voltage inputted from the first connector portion to the second connector portion.

* * * * *